US005797670A

United States Patent [19]

Snoke et al.

[11] Patent Number: 5,797,670

[45] Date of Patent: Aug. 25, 1998

[54] PORTABLE POWER TOOL LIGHT, ACCESSORY MOUNTING BELT, AND METHOD OF USING SAME

[75] Inventors: Phillip Jack Snoke, Atlanta; Michael John Mark, Suwanee; Javier Verdura, Marietta, all of Ga.; Kevin A. Nagatani, San Jose, Calif.

[73] Assignee: American Industrial Design Co., Inc., Atlanta, Ga.

[21] Appl. No.: 702,256

[22] Filed: Aug. 23, 1996

[51] Int. Cl.[6] ..... B25B 23/18

[52] U.S. Cl. ..... 362/119; 24/17 AP; 24/16 PB; 24/270; 362/191

[58] Field of Search ..... 362/119, 120, 362/190, 191, 32; 24/270, 17 AP, 16 PB; 248/74.3

[56] References Cited

U.S. PATENT DOCUMENTS

| | | | |
|---|---|---|---|
| D. 303,488 | 9/1989 | Fonck . | |
| D. 314,699 | 2/1991 | Tamosaitis et al. . | |
| D. 327,827 | 7/1992 | Kwan . | |
| D. 330,497 | 10/1992 | Hsin . | |
| D. 331,356 | 12/1992 | Amsberry . | |
| D. 359,215 | 6/1995 | Zurwelle . | |
| 1,595,896 | 8/1926 | Levine | 362/191 |
| 1,603,986 | 10/1926 | Rosenberg . | |
| 2,226,616 | 12/1940 | Kraus . | |
| 2,310,166 | 2/1943 | Way . | |
| 2,517,882 | 8/1950 | Johnson . | |
| 2,525,588 | 10/1950 | Cameron et al. . | |
| 2,588,288 | 3/1952 | Pohanka . | |
| 2,822,615 | 2/1958 | Durst et al. . | |
| 3,913,187 | 10/1975 | Okuda | 248/74.3 |
| 3,977,278 | 8/1976 | Jackson . | |
| 4,230,453 | 10/1980 | Reimers . | |
| 4,324,158 | 4/1982 | Le Roy et al. . | |
| 4,515,295 | 5/1985 | Dougherty | 362/191 |
| 4,631,782 | 12/1986 | Gecs | 24/17 AP |
| 4,642,738 | 2/1987 | Meller . | |
| 4,797,040 | 1/1989 | Hibbard . | |
| 4,817,901 | 4/1989 | Kuo | 248/74.3 |
| 4,881,301 | 11/1989 | Sweeney et al. | 24/16 PB |
| 4,954,026 | 9/1990 | Zurwelle . | |
| 4,973,205 | 11/1990 | Spaulding . | |
| 5,003,434 | 3/1991 | Gonser et al. . | |
| 5,056,661 | 10/1991 | Balzano . | |
| 5,136,757 | 8/1992 | Labonville | 24/270 |
| 5,158,354 | 10/1992 | Simonin . | |
| 5,169,225 | 12/1992 | Palm . | |
| 5,267,129 | 11/1993 | Anderson . | |
| 5,427,002 | 6/1995 | Edman . | |
| 5,445,479 | 8/1995 | Hillinger . | |
| 5,525,842 | 6/1996 | Leininger . | |

*Primary Examiner*—Carroll B. Dority

*Attorney, Agent, or Firm*—Allen Dyer Doppelt Milbrath & Gilchrist

[57] ABSTRACT

A portable power tool light for mounting to a portable power tool and method of using the portable power tool light are provided and preferably include a belt shaped to detachably mount to and surround a distal portion of a portable power tool. A portable power tool preferably has a power tool main body and a handle connected to and extending outwardly from the main body. The belt includes a fastener for securely fastening the belt to the outer surface of a distal portion of a portable power tool. Flexible lighting means preferably is connected to the belt and extends outwardly therefrom toward a distal portion of a power tool for flexibly positioning a light source to direct radiation from the light source toward an object for using the power tool thereon to thereby illuminate the object for increasing visibility of the object to the user of the power tool. The flexible lighting means preferably includes a base connected to the belt, an elongate, flexible arm connected to the base and extending outwardly therefrom, and a light head connected to the flexible arm for casting light onto an object for using the power tool thereon.

53 Claims, 4 Drawing Sheets

20
21
26
23
22
24
27
25
25a
50
51
52
53
54
55
30
31
35
41
40
32
42
43
43a

30'
26
31'
36
35'
62
63
47
48
40'

20'
35'
40'
30'
42
43
43a
50'
36
31'

PORTABLE POWER TOOL LIGHT, ACCESSORY MOUNTING BELT, AND METHOD OF USING SAME

FIELD OF THE INVENTION

The present invention relates to the field of industrial and consumer tools and, more particularly, to portable power tools and accessories.

BACKGROUND OF THE INVENTION

Over the years, various portable power tools have been developed, including portable power drills, for assisting a user in drilling a hole, driving a screw, sanding an object, tightening a bolt, and the like. In order to enable the user to view the distal end of the power tool more effectively, such as in low ambient environments, lights have be formed integrally with the power tool or fixedly mounted to the power tool. Examples of these power tools having lights thereon can be seen in U.S. Pat. No. 2,310,166 by Way titled *"Lighting Device For Portable Electric Tools"*, U.S. Pat. No. 2,588,288 by Pohanka title *"Dental Light"*, U.S. Pat. No. 331,356 by Amsberry titled *"Combined Drill And Light"*, and U.S. Pat. No. 4,324,158 by Le Roy titled *"Illuminated Wrench."*

Several problems, however, have arisen with these power tools over the years. For example, the use of a light is not always desired, and, therefore, some of these power tools have lights which use power and obstruct the view of a user of the tool. These conventional power tools with the fixed light make it difficult to radiate light toward some objects upon which the tool is to be used, make it difficult to position the light at an appropriate angle for viewing the object and/or the distal end of the tool, and make it difficult to the view the object and/or distal end of the tool is some positions and when a user has a hand or the like holding the object.

Various fabric holders for drill bits or tool heads of a power tool have also been developed over the years. These fabric holders include elastic straps for positioning on a power tool. Examples of these holders can be seen in U.S. Pat. No. 4,797,040 by Hibbard titled *"Strap On Drill Paraphernalia Holding System (DPHS)"* and U.S. Pat. No. 314,699 by Tamosaitis et al. titled *"Tool Accessory Holder Attachment For A Drill."* These straps, however, fail to provide a structure to support other accessories, such as a light, a magnifying glass, a level, or a gauge, and especially accessories that are somewhat heavier than a drill bit or small tool head. These prior straps also provide a flimsy appearance, wear down somewhat quickly after extended use, cannot be cleaned easily, and often slip during heavy duty use or when moisture, grease, shavings, or other particles accumulate on the power tool. Further, a separate conventional belt of a selected length is often necessary for each type and sized power tool. Otherwise, slippage is exacerbated, excess fabric can interfere with usage of the power tool, the elastic loses its recovery characteristics, and accidental or sudden release of the elasticized strap can be dangerous during use of the power tool.

OBJECTS AND SUMMARY OF THE INVENTION

With the foregoing in mind, it is an object of the present invention to provide a portable power tool light that readily secures to a portable power tool for radiating light to illuminate an object for which the portable power tool is to be used.

It is also an object of the present invention to provide a portable power tool, portable power tool light, and method that flexibly adjust a light source to various positions and retains its shapes and positions for effectively radiating light to illuminate an object and/or a distal end of a portable power tool without obscuring the view of a user either directly or when the user uses a hand to hold an object for use by the portable power tool.

It is another object of the present invention to provide a portable power tool belt that readily supports heavier power tool accessories such as a light or a magnifying glass.

It is yet another object of the present invention to provide a portable power tool belt and method of using a belt that does not readily slip during heavy duty use or when moisture, grease, shavings, or other particles accumulate on the power tool and that securely holds accessories when mounted on the belt when the belt is positioned on a portable power tool.

It is still another object of the present invention to provide a portable power tool belt and light that has a sturdy appearance and performance, that is durable, and that can readily be cleaned and maintained.

It is a further object of the present invention to provide a method of using a portable power tool light that flexibly adjusts a light source to various positions for effectively radiating light to illuminate an object and/or a distal end of a portable power tool without obscuring the view of a user either directly or when using the user uses a hand to hold an object for use by the portable power tool.

More particularly, a portable power tool light for mounting to a portable power tool is provided according to the present invention which preferably includes a belt shaped to detachably mount to and surround a distal portion of a portable power tool. A portable power tool preferably has a power tool main body and a handle connected to and extending outwardly from the main body. The belt includes a fastener for securely fastening the belt to the outer surface of a distal portion of a portable power tool. Flexible lighting means preferably is connected to the belt and extends outwardly therefrom toward a distal portion of a power tool for flexibly positioning a light source to direct radiation from the light source toward an object for using the power tool thereon to thereby illuminate the object for increasing visibility of the object to the user of the power tool. The flexible lighting means preferably includes a base connected to the belt, an elongate, flexible arm connected to the base and extending outwardly therefrom, and a light head connected to the flexible arm for casting light onto an object for using the power tool thereon. According to an alternate embodiment, the flexible lighting means can be connected or mounted directly to the portable power tool.

A portable power tool belt for mounting to a portable power tool according to the present invention is also provided which preferably includes a strap shaped to detachably mount to and surround a distal portion of a portable power tool. The strap is preferably formed of a polymeric material and includes a fastener for securely fastening the strap to the outer surface of a distal portion of a portable power tool. The fastener includes means for inhibiting slippage of the strap when positioned on a distal portion of a portable power tool. Light mounting means is also preferably connected to the strap for mounting a portable power tool light thereto.

Additionally, the portable power tool belt according to the present invention can also include a plurality of polymeric rigid slots defining accessory mounting clasps integrally formed as a unitary piece with the strap and extend outwardly therefrom for mounting a power tool accessory therein. The fastener can further include pivoting means connected to the strap and a clasp connected to the pivoting means and extending outwardly therefrom for adjusting and securing the position of the belt when positioned on a portable power tool.

Methods of using a portable power tool light according to the present invention are also provided. A first embodiment of such a method preferably includes adjustably positioning a portable power tool light on a distal end portion of a portable power tool, securing the portable power tool light to a selected position on the distal end portion of the portable power tool so as to inhibit slippage of the light when mounted on the portable power tool, and radiating light from the secured portable power tool light toward an object to thereby illuminate the object.

Another method of using a portable power tool light according to the present invention preferably includes adjustably positioning a portable power tool light on a distal end portion of a portable power tool. The portable power tool light is then secured to a selected position on the distal end portion of the portable power tool so as to inhibit slippage of the light when mounted on the portable power tool. The portable power tool light is flexibly positioned adjacent and toward an object so as not to obscure light to be radiated from the portable power tool light from illuminating the object when a user holds an object in a hand thereof. Light is radiated from the secured portable power tool light toward an object to thereby illuminate the object, and the portable power tool can then be operated or used on the illuminated object.

A method of using a portable power tool belt is further provided according to the present invention. The method preferably includes adjustably positioning a portable power tool belt so as to surround a distal end portion of a portable power tool and securing the portable power tool belt to a selected position on the distal end portion of the portable power tool so as to inhibit slippage of the belt when mounted on the portable power tool.

The portable power tool, portable power tool light, portable power tool belt, and methods of using the same advantageously provide an easy, secure, durable, and structurally sturdy system to modify existing portable power tools such as a power drill, a power screwdriver, or a power sander to add the capabilities to the tool for illuminating an object and/or the distal end of the power tool. The portable power tool light can readily and flexibly be positioned adjacent and toward an object and retain its position so as not to obscure light being radiated from the portable power tool light from the object when a user holds an object in a hand thereof. Other heavier and flexible accessories such as a magnifying glass, a level, a gauge, and heavier tool heads advantageously can also be readily mounted to the power tool when the portable power tool belt according to the present invention is positioned on a portable power tool. The use of a magnifying glass and light as described further enhances the capabilities of a user of a power tool particularly in dark places or low ambient environments or when eye fatigue occurs from continued use of the tool or late night use of the tool. Because the belt readily adjusts, the light and other accessories can be positioned to a desired location on the portable power tool.

BRIEF DESCRIPTION OF THE DRAWINGS

Some of the objects and advantages of the present invention having been stated, others will become apparent as the description proceeds when taken in conjunction with the accompanying drawings in which.

DETAILED DESCRIPTION

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. Like numbers refer to like elements throughout, and prime and double prime notation are used to indicate similar elements in alternative embodiments.

Figure 1:
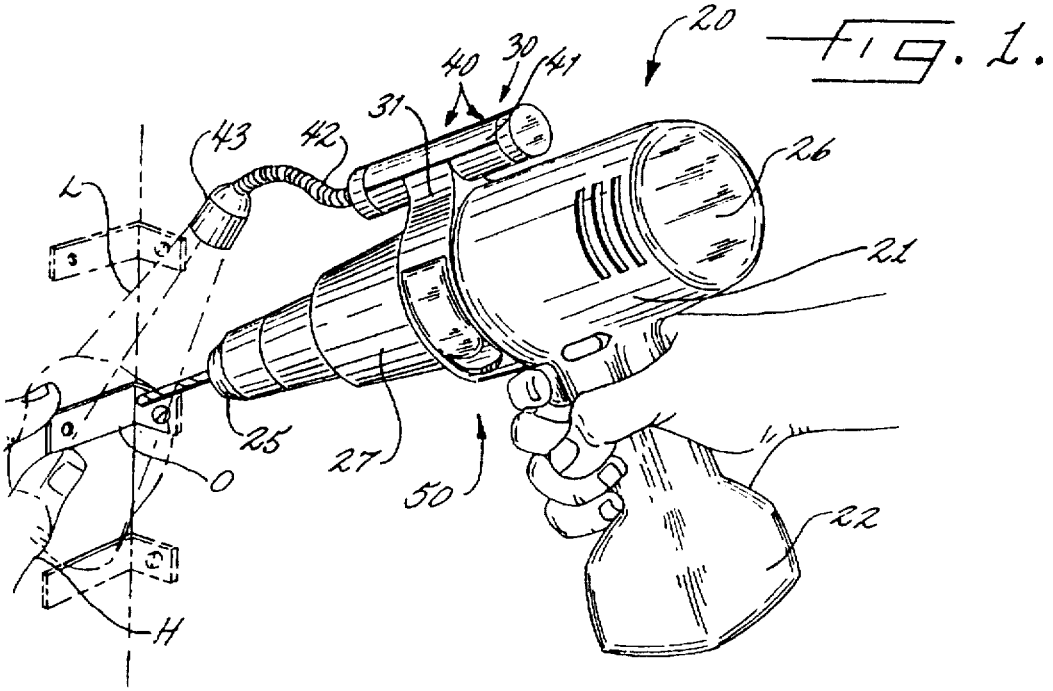
FIG. 1 is an environmental view of a portable power tool having a portable power tool light mounted to a distal end portion thereof and illuminating an object upon which to use the portable power tool according to a first embodiment of the present invention.
Figure 2:
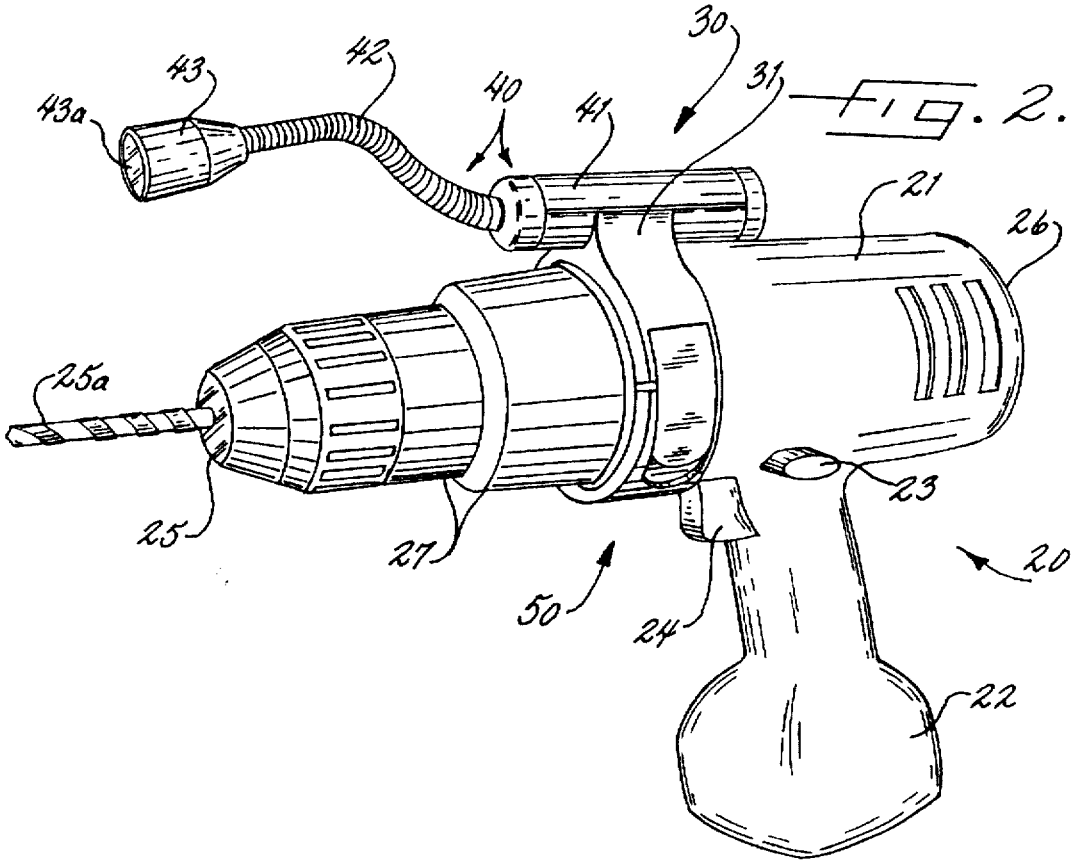
FIG. 2 is a perspective view of a portable power tool having a portable power tool light mounted to a distal end portion thereof according to a first embodiment of the present invention.
Figures 3, 4, 5:
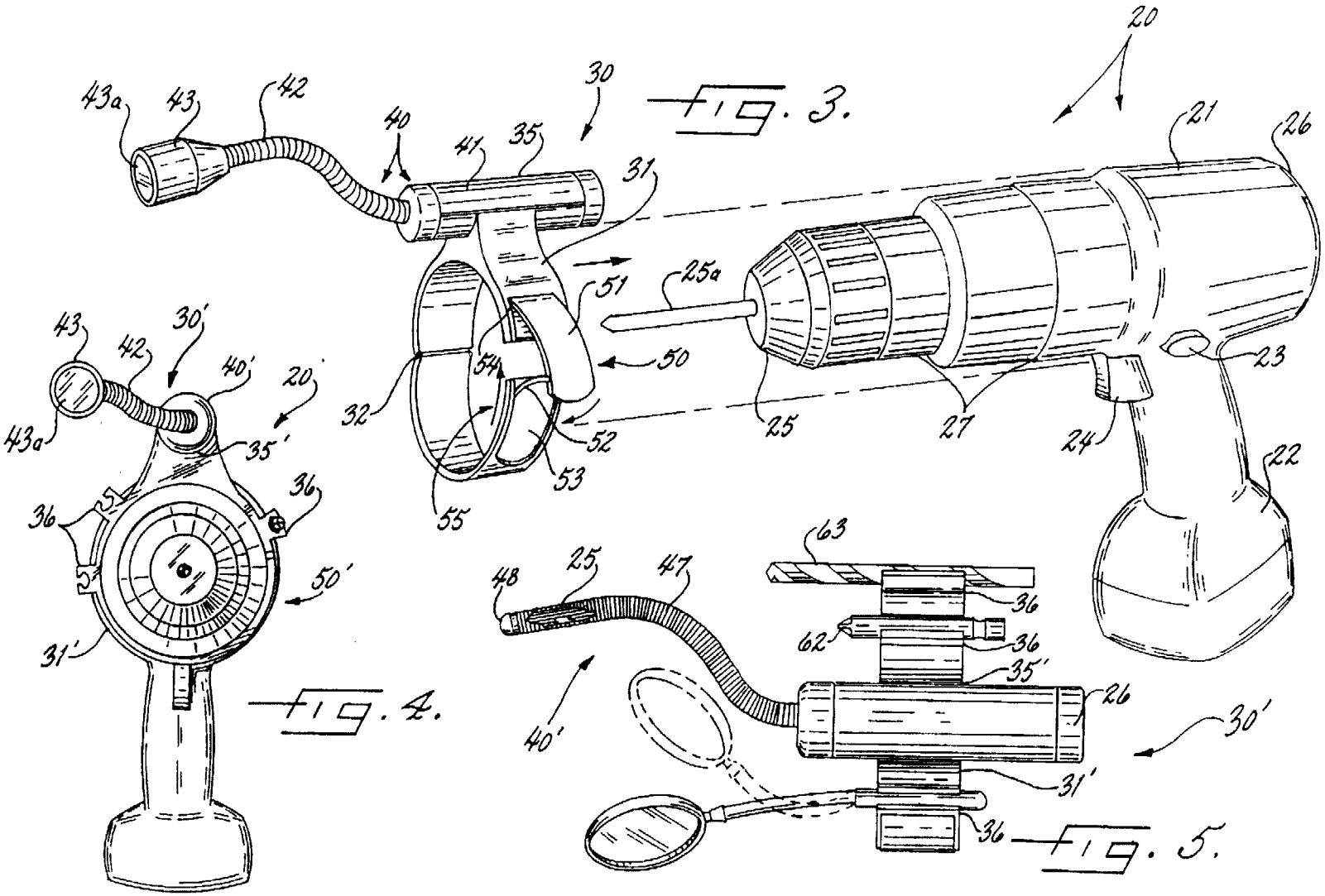
FIG. 3 is an exploded perspective view of a portable power tool and a portable power tool light which includes a belt and fastener according to a first embodiment of the present invention.
FIG. 4 is a front elevational view of a portable power tool having a portable power tool light mounted to a distal end portion thereof according to a second embodiment of the present invention.
FIG. 5 is a top plan view of a second embodiment of a portable power tool light which includes a belt and fastener according to a second embodiment of the present invention.

FIGS. 1–3 illustrate a portable power tool 20 having a portable power tool light 30 mounted thereon for illuminating an object O upon which the power tool 20 is to be used. FIG. 1, for example, illustrates an L-bracket being positioned and secured on a corner of two walls where ambient light often does not readily reach, where shadows are readily cast to obscure the area, and where a user's view is often greatly reduced. The portable power tool 20 as illustrated has a power tool main body 21 and a handle 22 connected to and extending outwardly from the main body 21. The main body 21, for example, includes a motor and a motor casing. A trigger or switch 24 is connected to and extends between the main body 21 and the handle 22, such as illustrated, for actuating the motor during operation of the tool 20. A trigger inhibiting or lock switch 23 can also be connected to either the handle or the main body for preventing the engagement of the trigger or motor.

A distal end 25 of the main body 21 has a tool head, such as drill bit 25*a*, positioned therein for operating upon an object O such as drilling a hole. A portable power tool light 30 according to a first embodiment of the present invention preferably is connected to the power tool main body 21 at a distal portion 27 thereof and extends outwardly therefrom toward the distal end 25 of the power tool 20. Although other portions of a portable power tool 20 are feasible for mounting a portable power tool light 30 according to the present invention, the portable power tool light 30 preferably mounts to the distal portion 27 of a portable power tool 20 because the motor casing, for example, provides a secure portion of the tool which does not readily interfere with a user's hand holding the tool 20 or the user's line of sight when using the tool 20. It also provides a position which can readily be balanced by a user when the additional weight of the light 30 to the tool 20 is considered.

A portable power tool light 30 according to the present invention is illustrated in FIGS. 1–9 in four different embodiments. Like elements are designated in prime (′), double prime (″), and triple prime (‴) notation for clarity purposes. The portable power tool light 30 preferably includes flexible lighting means 40 for flexibly positioning a light source 43*a* to direct radiation from the light source 43*a* toward an object O for using the power tool 20 thereon to thereby illuminate the object O for increasing visibility of the object O to the user of the power tool 20. The flexible lighting means 40 preferably includes a light mounting base 41 and an elongate, flexible arm 42 connected to the base 41 and extending outwardly therefrom for advantageously flexing and retaining a selected position so as not to obscure light L to be radiated from the portable power tool light 30 from illuminating the object O such as when a user holds the object O in a hand H thereof, as best illustrated in FIG. 1. A light head 43 is connected to the flexible arm 42 for casting light L onto an object O for using the power tool 20 thereon. The light head 43 preferably includes a light source 43*a* such as an incandescent lamp, other types of lamps, and/or other types of light sources as understood by those skilled in the art.

According to a first embodiment of the flexible lighting means 40 as best illustrated in FIGS. 1–3 and 8, the flexible lighting means 40 further includes a power source, such as a portable power source (e.g., a battery) or a conductor connected to the power source of the portable power tool 20, positioned in the base 41 and at least one conductor connected to the power source and extending outwardly therefrom. The flexible arm 42 preferably includes shape retaining means, e.g., a flexible outer tube and supporting structure, for flexing and retaining a selected position so as not to obscure light L to be radiated from the portable power tool light 30 from illuminating the object O when a user holds an object O in a hand thereof. As understood by those skilled in the art, the flexible outer tube can be formed of metal or plastic but preferably should have a construction so that the tube retains a desired position after selected by the user. The light head 43 preferably includes a light source 43*a* as described above. At least one conductor, and preferably a plurality of conductors, extends from the power source, through the flexible outer tube, and to the light source 43*a* of the light head 43 for supply power to the light head 43 to thereby radiate light L onto an object O for using the power tool 20 thereon.

According to a second embodiment of the flexible lighting means, as best illustrated in FIG. 5, the flexible lighting means 40′ advantageously further includes a light source positioned in a base 46 and at least one fiber optic strand, and preferably a plurality of fiber optic strands 45 as illustrated, having a proximal end thereof positioned adjacent the light source. As understood by those skilled in the art, the fiber optic strands can be formed of either glass or plastic and can be well suited for this type of use with a power tool. The use of fiber optic strands advantageously can also allow the light source to be other light sources such as light emitting diodes, lasers, vacuum fluorescent lamps, or electroluminescent light sources which often have a longer life-time, can have a variety of colors (e.g., matching a color scheme of a commercial manufacturer or a color found to be preferred for fatiguing eyes of a user), and are often require less power.

In this second embodiment of the flexible lighting means 40, the flexible arm 47 also includes a flexible outer tube for flexing and retaining a selected position so as not to obscure light L to be radiated from the portable power tool light 30′ from illuminating the object 0 when a user holds the object O in a hand H thereof. The plurality of fiber optic strands 45 extend from proximal ends positioned adjacent the light source, through the flexible outer tube, and to distal ends positioned adjacent a light head 48 for radiating light L onto an object O for using the power tool 20 thereon. Although FIG. 5 illustrates a light head 48 which for this embodiment can include only a lens or only a protective cover for the distal ends of the fiber optic strands 45. As understood by those skilled in the art, the first embodiment of the light head 43, however, would preferably include a reflector for the light source 43*a*.

Figure 7:
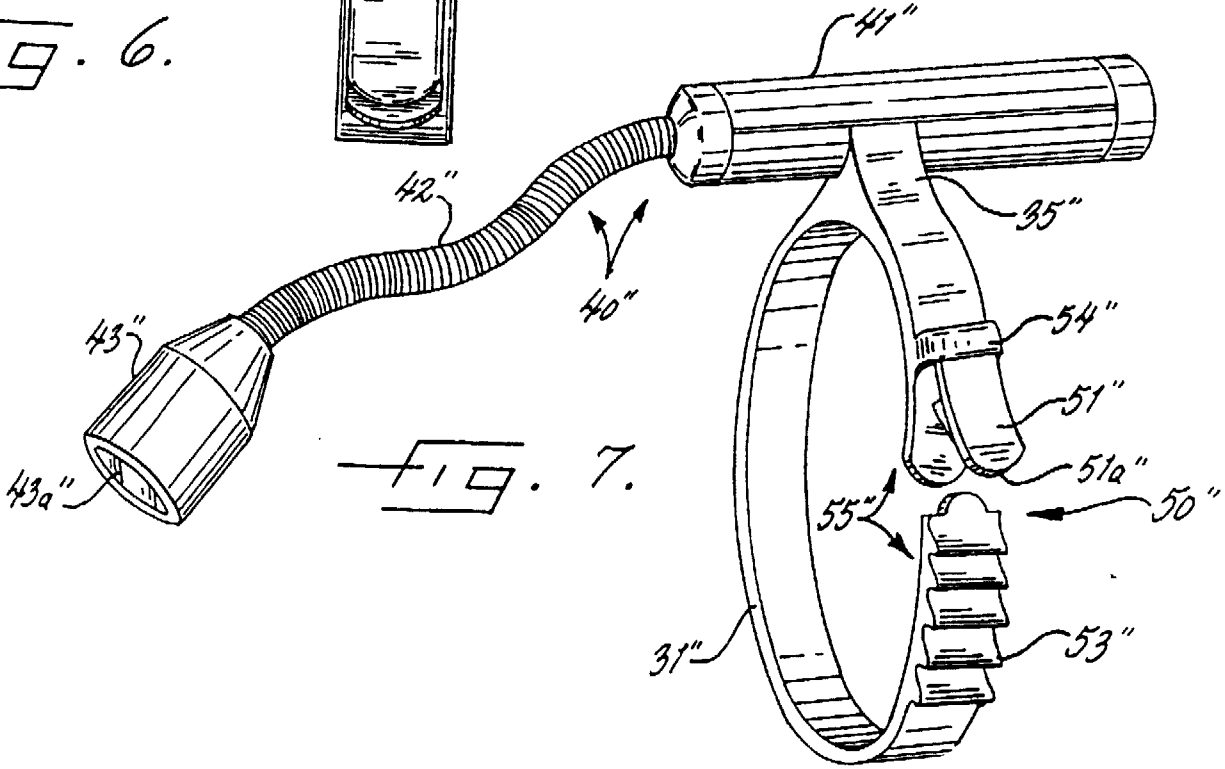
FIG. 7 is a perspective view of a portable power tool light which includes a belt and fastener according to a third embodiment a portable power tool light and belt of the present invention.

The portable power tool light 30 also preferably includes a belt 31 shaped to detachably mount to and surround a distal portion 27 of a portable power tool 20. The belt 31 includes fastening means, e.g. a fastener 50, for securely fastening the belt 31 to the outer surface of a distal portion 27 of a portable power tool 20. The belt 31 preferably has a generally circular shape and is formed of a rigid polymeric material. The belt 31 is preferably an elongate strap shaped to detachably mount to and surround the distal portion of a portable power tool 20 as illustrated and can also include a hinge 32 or other means for adjusting the size and/or position of the belt 31. Alternatively, the belt 31 can be formed of a bendable polymeric material which readily conforms to the shape of the portion of the power tool upon which the portable power tool light 30 is to be mounted. An example, of this type of belt 31″ is best illustrated in FIG. 7 which includes a two-position slip fastener that slidably adjusts the tightness of the belt around the power tool. In these embodiments of the belt 31, 31′, 31″, 31‴, the base 41 of the light 30 advantageously is connected to the belt 31 at an upper peripheral end thereof when positioned on the distal portion 27 of a portable power tool 20. This position advantageously inhibits the light 30 from readily interfering with movement of the user's hands when using the power tool 20, holding objects, and positioning the light for use. It will be understood by those skilled in the art, however, that other positions can be used as well according to the present invention.

The fastener 50 of the belt 31 preferably is connected to a side periphery of the belt. This location also advantageously provides a position from which the belt 31 can readily be adjusted and secured by the fastener 50 without interfering with the user's hand movement. It also provides a position of leverage for the user when opening and closing the fastener 50. It will also be understood by those skilled in the art that other positions on the belt 31 can also be used, however. The fastener 50 preferably includes slippage inhibiting means 55 for inhibiting slippage of the strap when positioned on a distal portion 27 of a portable power tool 20. Because the belt 31 can be flexibly and adjustably shaped for various sized and shaped power tools, the slippage inhibiting means preferably forms a desired grip or clamp on the portion of the power tool 20 to which the belt 31 is mounted. Hook and loop type fasteners alone, for example, mounted to a cloth or other fabric material fail to provide the grip or clamp for inhibiting slippage of the belt such as when grease or dirt accumulate on the power tool 20 and such as when heavier accessories are mounted to the fabric belt.

Figure 8:
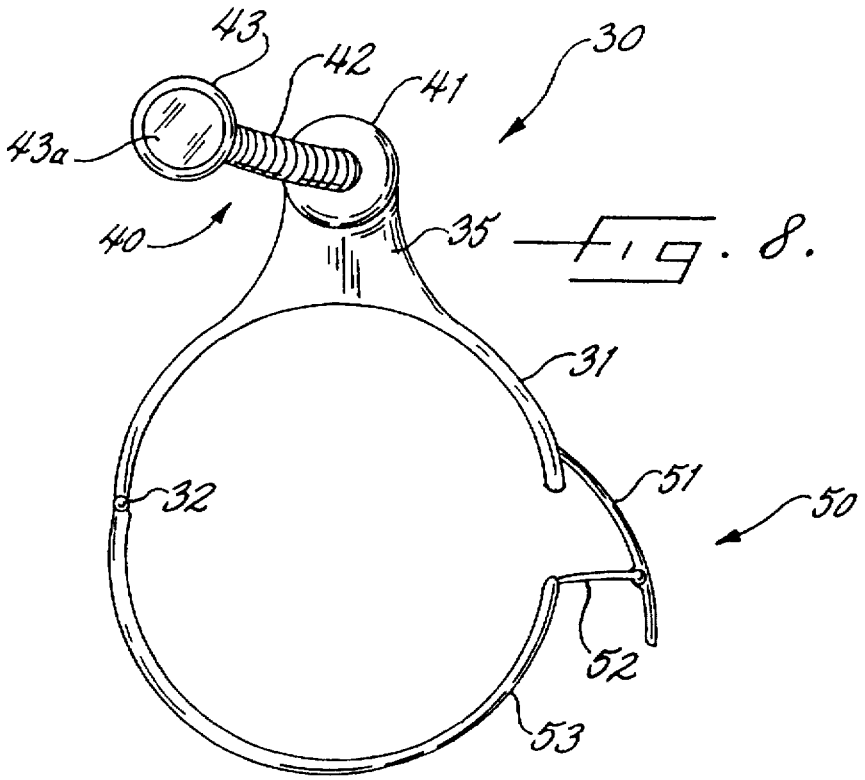
FIG. 8 is a front elevational view of a portable power tool light and belt according to a first embodiment of a portable power tool light and belt of the present invention.
Figure 9:
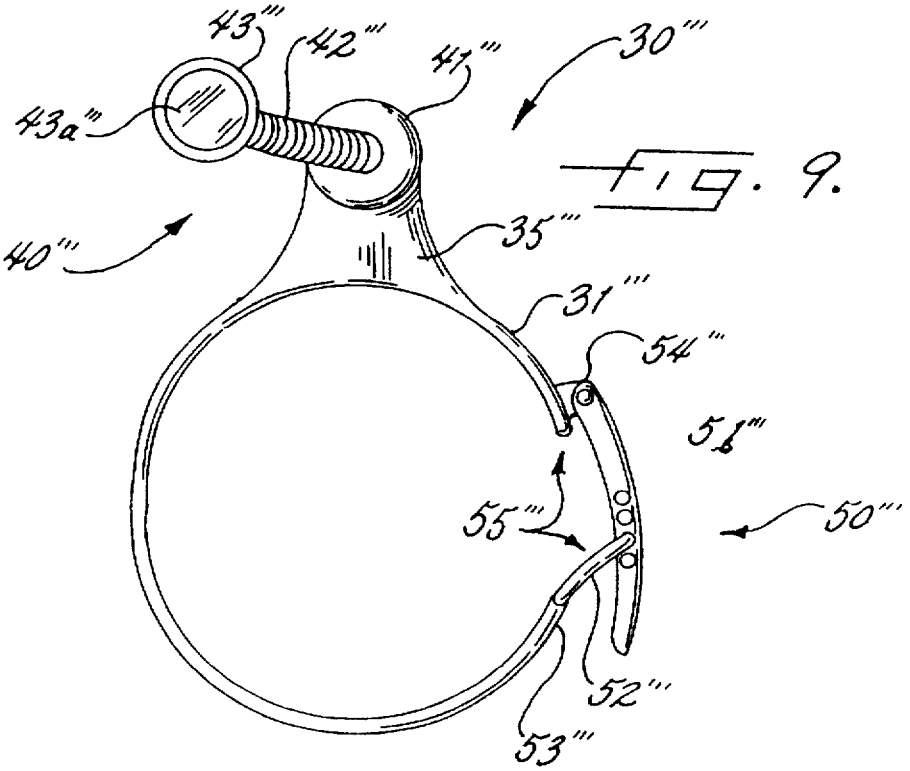
FIG. 9 is a front elevational view of a portable power tool light and belt according to a fourth embodiment of a portable power tool light and belt of the present invention.

As best illustrated in the first and fourth embodiments of a portable power tool light and belt of FIGS. 3 and 8–9, a first embodiment of the slippage inhibiting means 55 preferably includes a three-position clamp fastener having a first open position for mounting the belt or strap 31 on and removing the belt or strap 31 from a distal portion 27 of a portable power tool 20. A second radial adjust position radially adjusts the position of the belt 31 when mounted on a distal portion 27 of a portable power tool 20. A third lock position locks the belt 30 into a selected mounting location on a distal portion 27 of a portable power tool 20 by securely closing the fastener 50. This adjustment and lock, for example, can be accomplished by an adjustable strap 31 and fastener 50 arrangement somewhat like an oil filter wrench that slidably adjusts to the size and shape of the oil filter of a vehicle and then fastens to securely grip the oil filter to remove and/or mount the filter. Another example of this adjustment and lock, as illustrated in the first embodiment, can be accomplished by an adjustable strap 31 and fastener 50 somewhat like a ski boot fastener that adjusts to the size of a foot in this example, but to the size and shape of a power drill according to the present invention, and then securely fastens and locks into a desired position for heavy duty use.

FIG. 9, for example, includes a clasp 51 that has a plurality of openings positioned therein for adjusting the size of the belt 31'" for various sized and shaped power tools such as a portable power drill. This adjusting fastener 50'" advantageously allows the belt to securely conform to the shape of the portion of the power tool upon which it is mounted, e.g., circular, rectangular, or oval. This fourth embodiment, as understood by those skilled in the art, has a combination of the characteristics of the first and third embodiments of the belt 31 and fastener 50. It will also be understood by those skilled in the art that the belt 31 according to the present invention can also be formed of a stretchable polymeric material that will also permit the belt 31 to be readily adapt to various shapes and sizes of power tool, but, unlike conventional straps, such a belt 31 preferably has the structural strength, material, and durability as described in respect to the other embodiments and concepts of the present invention and also preferably has the ability to conform to the shape and size of the portion of the portable power tool upon which the belt is mounted.

Figure 6:
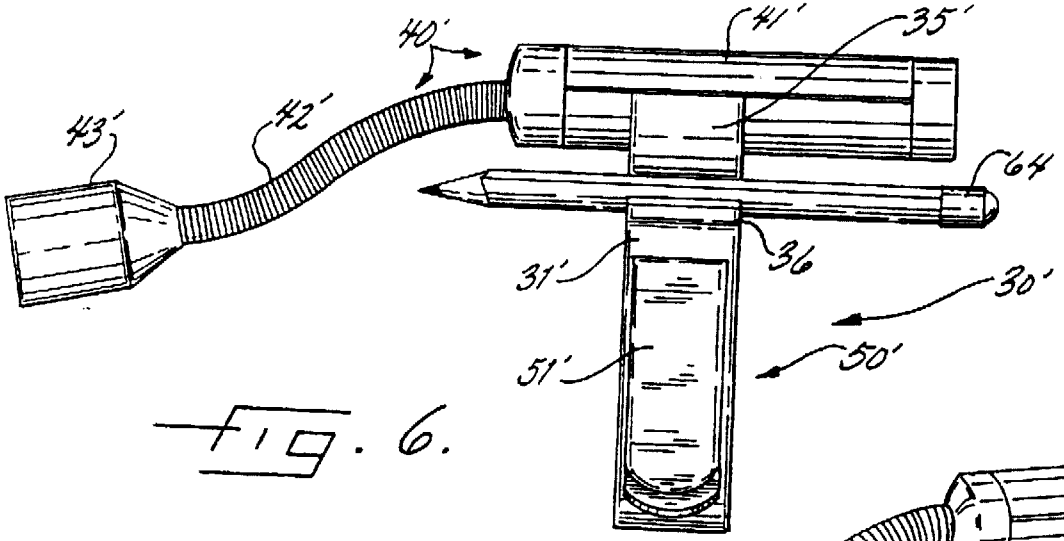
FIG. 6 is a side elevational view of a portable power tool light which includes a belt and fastener according to a second embodiment of a portable power tool light and belt of the present invention.

As best illustrated in the third embodiment of a portable power tool light and belt of FIG. 6, a second embodiment of the slippage inhibiting means 55" includes a two-position slip fastener having a first adjustably open position for adjustably mounting the belt 31" on and removing the belt 31" from a distal portion 27 of a portable power tool 20. A second lock position locks the belt 31" into a selected mounting location on a distal portion 27 of a portable power tool 20. As will be understood by those skilled in the art, this fastener 50" advantageously allows an end of the strap 31 to readily slide through a loop or ring 54" connected to or integrally formed with the other end of the strap 31" and clasp or hold the mating clasp 53" into a locked desired position by a downward extending flange 51*a"*.

The fastener 50 further includes pivoting means 54, e.g., a mounting rod mounted into slots or a living hinge, connected to the strap 31 and a clasp 51 connected to the pivoting means 54 and extending outwardly therefrom. A slip ring or other clasp adjuster 52 preferably is connected to a portion of the strap 31 and a portion of the clasp 51 for slidably adjusting and closing the strap 31. A mating clasp or clasp end 53 is connected to the strap 31 for fastening and locking the clasp into a preselected position.

At least one polymeric rigid slot 36, and preferably a plurality of rigid slots 35, 36, defines an accessory mounting clasp or docking port which is integrally formed as a unitary piece with the strap 31 and extends outwardly therefrom for mounting a power tool accessory therein. At least one of the mounting clasps 35, 36 preferably forms light mounting means, e.g., a light mount 35, integrally formed as a unitary piece with the belt 31 and extending outwardly therefrom for mounting the flexible lighting means 40 or other light source therein. The base 41 of the flexible lighting means 40 can either be fixedly secured, e.g., using a retainer and/or adhesive material, to the light mount 35 or detachably connected, e.g., a clasp-type grip, to the light mount 35 as understood by those skilled in the art. The mounting configuration of the light mount 35 as illustrated in FIGS. 1–4 advantageously has an increased thickness of polymeric material raised from the surface of the belt 31 for increased structural strength and increased surface area contact for holding the heavier flexible lighting means 40.

Each of the other accessory mounting clasps 36 preferably has a circular-shaped slot having an open end thereof. Peripheral upper edges of the slot preferably are deformable from a first relaxed position for positioning an accessory into the open end and retaining an accessory therein when in an at least partially deformed position. The slots 36 preferably are recessed T-slots, but other clasps or accessory docking ports configured to hold heavier, as well as light, accessories can be used as well according to the present invention. As illustrated in FIGS. 5–6, the clasps 36 advantageously are constructed to hold heavier as well as lighter power tool accessories, such as a magnifying glass 61, a level, a gauge, heavier drill bits 62, 63, pencils 64, and/or pens, and can readily be inserted and released by a user of the power tool 20. Because the belt 31 readily adjusts and then securely fastens, the light 30 and other accessories can be positioned to a desired location on the portable power tool 20.

As illustrated in FIGS. 1–9, the present invention also includes methods of using a portable power tool light 30 and a portable power tool belt 31. A first embodiment of a method of using a portable power tool light 30 preferably includes adjustably positioning a portable power tool light 30 on a distal portion 27 of a portable power tool 20. The portable power tool light 30 is secured to a selected position on the distal portion 27 of the portable power tool 20 so as to inhibit slippage of the light 30 when mounted on the portable power tool 20. Light L is radiated from the secured portable power tool light 30 toward an object O to thereby illuminate the object O. The portable power tool 20 can then be operated or used on the illuminated object O.

A second embodiment of method of using a portable power tool light 30, according to the present invention, preferably includes adjustably positioning a portable power tool light 30 on a distal portion 27 of a portable power tool 20. The portable power tool light 30 is then secured to a selected position on the distal portion 27 of the portable power tool 20 so as to inhibit slippage of the light 30 when mounted on the portable power tool 20. The portable power tool light 30 is flexibly positioned adjacent and toward an object O so as not to obscure light L to be radiated from the portable power tool light 30 from illuminating the object O when a user holds an object in a hand H thereof. Light L is radiated from the secured portable power tool light 30 toward an object O to thereby illuminate the object O, and the portable power tool 20 can then be operated or used on the illuminated object O.

A method of using a portable power tool belt 31 is also included according to the present invention. The method preferably includes adjustably positioning a portable power tool belt 31 so as to surround a distal portion 27 of a portable power tool 20 and securing the portable power tool belt 31 to a selected position on the distal portion 27 of the portable power tool 20 so as to inhibit slippage of the belt 31 when mounted on the portable power tool 20. The method can further includes flexibly positioning a light 30 connected to the belt 31 adjacent and toward an object O so as not to obscure light L to be radiated from the light 30 from illuminating the object O when a user holds an object in a hand H thereof and flexibly positioning a magnifying glass 61 between the light head 43 and the object O to magnify the light L transmitted toward the object O. Alternatively, the magnifying glass 61 also can be flexibly positioned adjacent the object O and retain its shape and position for magnifying the illumined object O for more easily viewing by a user. The use of a magnifying glass 61 and light 30 as described further enhances the capabilities of a user of a power tool 20 particularly in dark places or low ambient environments or when eye fatigue occurs from continued use of the tool or late night use of the tool.

As illustrated in FIGS. 1–9 and as described above, the portable power tool 20, portable power tool light 30, portable power tool belt 31, and methods of using the same advantageously provide an easy, secure, and structurally sturdy apparatus to modify existing portable power tools such as a power drill, a power screwdriver, or a power sander to add the capabilities to the tool for illuminating an object and/or the distal end of the power tool. The portable power tool light 30 can readily and flexibly be positioned adjacent and toward an object O so as not to obscure light L being radiated from the portable power tool light 30 from the object O when a user holds an object in a hand H thereof. Other heavier and flexible accessories such as a magnifying glass 61, a level, a gauge, and heavier tool heads or bits 62, 63 advantageously can also be readily mounted to the power tool 20 when the portable power tool belt 31 according to the present invention is positioned on the power tool 20.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. A portable power tool light for mounting to a portable power tool, the power tool light comprising:

a belt shaped to detachably mount to and surround a distal portion of a portable power tool, said belt including a fastener for securely fastening said belt to the outer surface of a distal portion of a portable power tool; and flexible lighting means connected to said belt and extending outwardly therefrom toward a distal portion of a power tool for flexibly positioning a light source to direct radiation from the light source toward an object for using the power tool thereon to thereby illuminate the object for increasing visibility of the object to the user of the power tool, said flexible lighting means including a base connected to said belt, an elongate, flexible arm connected to said base and extending outwardly therefrom, and a light head connected to said flexible arm for casting light onto an object for using the power tool thereon.

2. A portable power tool light as defined in claim 1, wherein said belt has a generally circular shape and is formed of a rigid polymeric material, said base of said light is connected to said belt at an upper peripheral end thereof when positioned on the distal portion of a portable power tool, and said fastener of said belt is connected to a side periphery of said circular-shaped belt.

3. A portable power tool light as defined in claim 1, wherein said belt is formed of a rigid polymeric material and further includes at least one accessory mounting clasp integrally formed as a unitary piece with said belt and extending outwardly therefrom for mounting a power tool accessory therein.

4. A portable power tool light as defined in claim 3, wherein said at least one accessory mounting clasp includes a slot for positioning a power tool accessory therein.

5. A portable power tool light as defined in claim 1, wherein said flexible lighting means further includes a light source positioned in said base and a plurality of fiber optic strands having proximal ends thereof positioned adjacent said light source, wherein said flexible arm includes a flexible outer tube for flexing and retaining a selected shape and position so as not to obscure light to be radiated from the portable power tool light from illuminating the object when a user holds an object in a hand thereof, and wherein said plurality of fiber optic strands extend from said light source, through said flexible outer tube, and to said light head for radiating light onto an object for using the power tool thereon.

6. A portable power tool light as defined in claim 1, wherein said flexible lighting means further includes a power source positioned in said base and at least one conductor connected to said power source and extending outwardly therefrom, wherein said flexible arm includes a flexible outer tube for flexing and retaining a selected shape and position so as not to obscure light to be radiated from the portable power tool light from illuminating the object when a user holds an object in a hand thereof, wherein said light head includes a light source, and wherein said at least one conductor extends from said power source, through said flexible outer tube, and to said light source of said light head for supply power to said light head to thereby radiate light onto an object for using the power tool thereon.

7. A portable power tool light as defined in claim 1, wherein said fastener of said belt comprises slippage inhibiting means for inhibiting slippage of said belt when mounted on a distal portion of a portable power tool, said slippage inhibiting means including a three-position clamp fastener having a first open position for mounting said belt on and removing said belt from a distal portion of a portable power tool, a second radial adjust position for radially adjusting the position of said belt when mounted on a distal portion of a portable power tool, and a third lock position for locking said belt into a selected mounting location on a distal portion of a portable power tool.

8. A portable power tool light as defined in claim 1, wherein said fastener of said belt comprises slippage inhibiting means for inhibiting slippage of said belt when mounted on a distal portion of a portable power tool, said slippage inhibiting means including a two-position slip fastener having a first adjustably open position for adjustably mounting said belt on and removing said belt from a distal portion of a portable power tool and a second lock position for locking said belt into a selected mounting location on a distal portion of a portable power tool.

9. A portable power tool light as defined in claim 1, wherein said belt includes a rigid polymeric strap, a rigid polymeric fastener secured to said strap, and a plurality of rigid slots defining accessory mounting clasps integrally formed as a unitary piece with said strap and extending outwardly therefrom for mounting a power tool accessory therein, said fastener having pivoting means connected to said strap and a clasp connected to said pivoting means and extending outwardly therefrom.

10. A portable power tool light for mounting to a portable power tool, the power tool light comprising:

a belt shaped to detachably mount to a distal portion of a portable power tool, said belt including a fastener for securely fastening said belt to the outer surface of a distal portion of a portable power tool; and a flexible light connected to said belt, said flexible light including a base connected to said belt, an elongate, flexible arm connected to said base and extending outwardly therefrom, and a light head connected to said flexible arm for casting light onto an object for using the power tool thereon.

11. A portable power tool light as defined in claim 10, wherein said belt has a generally circular shape and is formed of a rigid polymeric material, said base of said light is connected to said belt at an upper peripheral end thereof when positioned on the distal portion of a portable power tool, and said fastener of said belt is connected to a side periphery of said circular-shaped belt.

12. A portable power tool light as defined in claim 11, wherein said belt is formed of a rigid polymeric material and further includes at least one accessory mounting clasp integrally formed as a unitary piece with said belt and extending outwardly therefrom for mounting a power tool accessory therein.

13. A portable power tool light as defined in claim 12, wherein said at least one accessory mounting clasp includes a slot for positioning a power tool accessory therein.

14. A portable power tool light as defined in claim 13, wherein said flexible light further includes a light source positioned in said base and a plurality of fiber optic strands having proximal ends thereof positioned adjacent said light source, wherein said flexible arm includes a flexible outer tube for flexing and retaining a selected shape and position so as not to obscure light to be radiated from the portable power tool light from illuminating the object when a user holds an object in a hand thereof, and wherein said plurality of fiber optic strands extend from said light source, through said flexible outer tube, and to said light head for radiating light onto an object for using the power tool thereon.

15. A portable power tool light as defined in claim 13, wherein said flexible light further includes a power source positioned in said base and at least one conductor connected to said power source and extending outwardly therefrom, wherein said flexible arm includes a flexible outer tube for flexing and retaining a selected shape and position so as not to obscure light to be radiated from the portable power tool light from illuminating the object when a user holds an object in a hand thereof, wherein said light head includes a light source, and wherein said at least one conductor extends from said power source, through said flexible outer tube, and to said light source of said light head for supply power to said light head to thereby radiate light onto an object for using the power tool thereon.

16. A portable power tool light as defined in claim 14, wherein said fastener of said belt comprises a three-position clamp fastener for inhibiting slippage of said belt when mounted on a distal portion of a portable power tool, said three-position clamp fastener having a first open position for mounting said belt on and removing said belt from a distal portion of a portable power tool, a second radial adjust position for radially adjusting the position of said belt when mounted on a distal portion of a portable power tool, and a third lock position for locking said belt into a selected mounting location on a distal portion of a portable power tool.

17. A portable power tool light as defined in claim 14, wherein said fastener of said belt comprises a two-position slip fastener for inhibiting slippage of said belt when mounted on a distal portion of a portable power tool, said two-position slip fastener having a first adjustably open position for adjustably mounting said belt on and removing said belt from a distal portion of a portable power tool and a second lock position for locking said belt into a selected mounting location on a distal portion of a portable power tool.

18. A portable power tool light as defined in claim 10, wherein said belt includes a rigid polymeric strap, a rigid polymeric fastener secured to said strap, and a plurality of rigid slots defining accessory mounting clasps integrally formed as a unitary piece with said strap and extending outwardly therefrom for mounting a power tool accessory therein, said fastener having pivoting means connected to said strap and a clasp connected to said pivoting means and extending outwardly therefrom.

19. A portable power tool light as defined in claim 18, wherein each of said accessory mounting clasps comprises a circular-shaped slot having an open end thereof and peripheral upper edges of said slot being deformable from a first relaxed position for positioning an accessory into said open end and retaining an accessory therein when in an at least partially deformed position.

20. A portable power tool for illuminating an object for using the power tool thereon, the power tool comprising:

a main body;

a handle connected to and extending outwardly from said main body; and a portable power tool light connected to said main body and extending outwardly therefrom toward a distal portion of the power tool, said portable power tool light including flexible lighting means for flexibly positioning a light source to direct radiation from the light source toward an object for using the power tool thereon to thereby illuminate the object for increasing visibility of the object to the user of the power tool, said flexible lighting means including a base mounted to said main body, an elongate, flexible arm connected to said base and extending outwardly therefrom, and a light head connected to said flexible arm for casting light onto an object for using the power tool thereon.

21. A portable power tool as defined in claim 20, wherein said portable power tool light further includes a belt having a generally circular shape and being formed of a rigid polymeric material, said base of said light being connected to said belt at an upper peripheral end thereof when positioned on the distal portion of a portable power tool, and said belt also having a fastener connected to a side periphery of said circular-shaped belt.

22. A portable power tool as defined in claim 21, wherein said belt further includes at least one accessory mounting clasp integrally formed as a unitary piece with said belt and extending outwardly therefrom for mounting a power tool accessory therein.

23. A portable power tool as defined in claim 22, wherein said at least one accessory mounting clasp includes a slot for positioning a power tool accessory therein.

24. A portable power tool as defined in claim 23, wherein said flexible lighting means further includes a light source positioned in said base and a plurality of fiber optic strands having proximal ends thereof positioned adjacent said light source, wherein said flexible arm includes a flexible outer tube for flexing and retaining a selected shape and position so as not to obscure light to be radiated from the portable power tool light from illuminating the object when a user holds an object in a hand thereof, and wherein said plurality of fiber optic strands extend from said light source, through said flexible outer tube, and to said light head for radiating light onto an object for using the power tool thereon.

25. A portable power tool as defined in claim 23, wherein said flexible lighting means further includes a power source positioned in said base and at least one conductor connected to said power source and extending outwardly therefrom, wherein said flexible arm includes a flexible outer tube for flexing and retaining a selected shape and position so as not to obscure light to be radiated from the portable power tool light from illuminating the object when a user holds an object in a hand thereof, wherein said light head includes a light source, and wherein said at least one conductor extends from said power source, through said flexible outer tube, and to said light source of said light head for supply power to said light head to thereby radiate light onto an object for using the power tool thereon.

26. A portable power tool as defined in claim 23, wherein said fastener of said belt comprises a three-position clamp fastener for inhibiting slippage of said belt when mounted on the distal portion of the portable power tool, said three-position clamp fastener having a first open position for mounting said belt on and removing said belt from a distal portion of a portable power tool, a second radial adjust position for radially adjusting the position of said belt when mounted on a distal portion of a portable power tool, and a third lock position for locking said belt into a selected mounting location on a distal portion of a portable power tool.

27. A portable power tool as defined in claim 23, wherein said fastener of said belt comprises a two-position slip fastener for inhibiting slippage of said belt when mounted on the distal portion of the portable power tool, said two-position slip fastener having a first adjustably open position for adjustably mounting said belt on and removing said belt from a distal portion of a portable power tool and a second lock position for locking said belt into a selected mounting location on a distal portion of a portable power tool.

28. A portable power tool as defined in claim 20, wherein said portable power tool light further includes a belt, said belt including a rigid polymeric strap, a rigid polymeric fastener secured to said strap, and a plurality of rigid slots defining accessory mounting clasps integrally formed as a unitary piece with said strap and extending outwardly therefrom for mounting a power tool accessory therein, said fastener having pivoting means connected to said strap and a clasp connected to said pivoting means and extending outwardly therefrom.

29. A portable power tool as defined in claim 28, wherein each of said accessory mounting clasps comprises a circular-shaped slot having an open end thereof and peripheral upper edges of said slot being deformable from a first relaxed position for positioning an accessory into said open end and retaining an accessory therein when in an at least partially deformed position.

30. A portable power tool belt for mounting to a relatively smooth outer surface of a portable power tool, the power tool belt comprising:

a strap shaped to detachably mount to and surround a distal portion of a portable power tool, the distal portion having a relatively smooth outer surface, said strap formed of a polymeric material and including a fastener for securely fastening said strap to the relatively smooth outer surface of a distal portion of a portable power tool, said fastener including means for inhibiting slippage of said strap when positioned on the relatively smooth outer surface of a portable power tool, said slippage inhibiting means including adjustable biasing means for biasing polymeric inner surfaces of said strap inwardly into abutting contact with the relatively smooth outer surface, said strap further including accessory mounting means for mounting at least one power tool accessory thereto, said accessory mounting means including recess holding means formed in the outer surface of the strap for mounting at least one power tool accessory therein.

31. A portable power tool belt as defined in claim 30, wherein said recess holding means includes a plurality of polymeric rigid slots defining accessory mounting clasps integrally formed as a unitary piece with said strap and extending outwardly therefrom for mounting a power tool accessory therein, said fastener further including pivoting means connected to said strap and a clasp connected to said pivoting means and extending outwardly therefrom.

32. A combination as defined in claim 31, wherein each of said accessory mounting clasps comprises a circular-shaped slot having an open end thereof and peripheral upper edges of said slot being deformable from a first relaxed position for positioning an accessory into said open end and retaining an accessory therein when in an at least partially deformed position.

33. A portable power tool belt as defined in claim 30, wherein said recess holding means includes at least one accessory mounting clasp integrally formed as a unitary piece with said strap and extending outwardly therefrom for mounting a power tool accessory therein.

34. A combination as defined in claim 33, wherein said at least one accessory mounting clasp includes a slot for positioning a power tool accessory therein.

35. A combination as defined in claim 30, wherein said slippage inhibiting means includes a three-position clamp fastener having a first open position for mounting the belt on and removing the belt from the portion of the portable power tool, a second radial adjust position for radially adjusting the position of the belt when mounted on the portion of the portable power tool, and a third lock position for locking the belt into a selected mounting location on a distal portion of a portable power tool.

36. A combination as defined in claim 30, wherein said slippage inhibiting means includes a two-position slip fastener having a first adjustably open position for adjustably mounting the belt on and removing the belt from the portion of the portable power tool and a second lock position for locking the belt into a selected mounting location on the portion of the portable power tool.

37. A combination of a portable power tool and a portable power tool belt mounted to the portable power tool, the power tool belt comprising a strap shaped so as to detachably mount to and surround a portion of the portable power tool, said strap formed of a polymeric material and including a fastener for securely fastening said strap to the outer surface of the portion of the portable power tool, said fastener including means for inhibiting slippage of said strap, and light mounting means connected to said strap for mounting a portable power tool light thereto.

38. A combination as defined in claim 37, further comprising a plurality of polymeric rigid slots defining accessory mounting clasps integrally formed as a unitary piece with said strap and extending outwardly therefrom for mounting a power tool accessory therein, said fastener further including pivoting means connected to said strap and a clasp connected to said pivoting means and extending outwardly therefrom.

39. A combination as defined in claim 38, wherein each of said accessory mounting clasps comprises a circular-shaped slot having an open end thereof and peripheral upper edges of said slot being deformable from a first relaxed position for positioning an accessory into said open end and retaining an accessory therein when in an at least partially deformed position.

40. A combination as defined in claim 37, further comprising at least one accessory mounting clasp integrally formed as a unitary piece with said strap and extending outwardly therefrom for mounting a power tool accessory therein.

41. A combination as defined in claim 40, wherein said at least one accessory mounting clasp includes a slot for positioning a power tool accessory therein.

42. A combination as defined in claim 41, wherein said slippage inhibiting means includes a three-position clamp fastener having a first open position for mounting the belt on and removing the belt from the portion of the portable power tool, a second radial adjust position for radially adjusting the position of the belt when mounted on the portion of the portable power tool, and a third lock position for locking the belt into a selected mounting location on a distal portion of a portable power tool.

43. A combination as defined in claim 41, wherein said slippage inhibiting means includes a two-position slip fastener having a first adjustably open position for adjustably mounting the belt on and removing the belt from the portion of the portable power tool and a second lock position for locking the belt into a selected mounting location on the portion of the portable power tool.

44. A combination as defined in claim 37, wherein said light mounting means comprises a light accessory mount connected to and integrally formed as a unitary piece with said strap for mounting a light thereto.

45. A combination as defined in claim 37, wherein said belt is formed of a stretchable polymeric material that readily conforms to a plurality of different shapes and sizes.

46. A method of using a portable power tool light, the method comprising:

adjustably mounting a portable power tool light on a distal end portion of a portable power tool;

securing the portable power tool light to a selected position on the distal end portion of the portable power tool so as to inhibit slippage of the light when mounted on the portable power tool;

flexibly positioning, relative to the power tool, only selected portions of the portable power tool light positioned on the distal end portion of the portable power tool so as to direct light to be radiated from the portable power tool light for illuminating an object to be worked thereon and radiating light from the secured portable power tool light toward the object to thereby illuminate the object.

47. A method of using a portable power tool light, the method comprising:

adjustably positioning a portable power tool light on a distal end portion of a portable power tool;

securing the portable power tool light to a selected position on the distal end portion of the portable power tool so as to inhibit slippage of the light when mounted on the portable power tool;

flexibly positioning, relative to the power tool, only selected portions of the portable power tool light positioned on the distal end portion of the portable power tool so as to direct light to be radiated from the portable power tool light for illuminating an object to be worked thereof;

radiating light from the secured portable power tool light toward the object to thereby illuminate the object; and operating the portable power tool on the illuminated object.

48. A method of using a portable power tool belt, the method comprising:

adjustably mounting a portable power tool belt having a flexible power tool light connected thereto so that the portable power tool belt surrounds a distal end portion of a portable power tool;

securing the portable power tool belt to a selected position on the distal end portion of the portable power tool so as to inhibit slippage of the belt when mounted on the portable power tool; and flexibly positioning, relative to the power tool, only selected portions of the portable power tool light positioned on the distal end portion of the portable power tool so as to direct light to be radiated from the portable power tool light for illuminating an object to be worked thereon.

49. A portable power tool belt for mounting to a portable power tool, the power tool belt comprising:

a strap shaped to detachably mount to and surround a distal portion of a portable power tool, said strap formed of a polymeric material;

a fastener for securely fastening said strap to an outer surface of a distal portion of a portable power tool, said fastener including means for inhibiting slippage of said strap, pivoting means connected to said strap, and a clasp connected to said pivoting means and extending outwardly therefrom; and a plurality of polymeric rigid slots defining accessory mounting clasps integrally formed as a unitary piece with said strap and extending outwardly therefrom for mounting a power tool accessory therein, each of said accessory mounting clasps comprises a circular-shaped slot having an open end thereof and peripheral upper edges of said slot being deformable from a first relaxed position for positioning an accessory into said open end and retaining an accessory therein when in an at least partially deformed position.

50. A portable power tool belt for mounting to a portable power tool, the power tool belt comprising:

a strap shaped to detachably mount to and surround a distal portion of a portable power tool, said strap formed of a polymeric material;

a fastener for securely fastening said strap to the outer surface of a distal portion of a portable power tool, said fastener including means for inhibiting slippage of said strap, pivoting means connected to said strap, and a clasp connected to said pivoting means and extending outwardly therefrom;

light mounting means connected to said strap for mounting a portable power tool light thereto; and a plurality of polymeric rigid slots defining accessory mounting clasps integrally formed as a unitary piece with said strap and extending outwardly therefrom for mounting a power tool accessory therein.

51. A portable power tool belt as defined in claim 50, wherein each of said accessory mounting clasps comprises a circular-shaped slot having an open end thereof and peripheral upper edges of said slot being deformable from a first relaxed position for positioning an accessory into said open end and retaining an accessory therein when in an at least partially deformed position.

52. A portable power tool belt for mounting to a portable power tool, the power tool belt comprising:

a strap shaped to detachably mount to and surround a distal portion of a portable power tool, said strap formed of a polymeric material and including a fastener for securely fastening said strap to the outer surface of a distal portion of a portable power tool, said fastener including means for inhibiting slippage of said strap; and a plurality of polymeric rigid slots defining accessory mounting clasps molded as a unitary piece with said strap and extending outwardly therefrom for mounting a power tool accessory therein, said fastener further including pivoting means connected to said strap and a clasp connected to said pivoting means and extending outwardly therefrom.

53. A portable power tool belt for mounting to a portable power tool, the power tool belt comprising:

a strap shaped to detachably mount to and surround a distal portion of a portable power tool, said strap formed of a polymeric material and including a fastener for securely fastening said strap to the outer surface of a distal portion of a portable power tool, said fastener including means for inhibiting slippage of said strap; and at least one accessory mounting clasp molded as a unitary piece with said strap and having ends extending outwardly therefrom for mounting a power tool accessory therein.

* * * * *